US005419025A

United States Patent [19]

Murakami et al.

[11] Patent Number: 5,419,025

[45] Date of Patent: May 30, 1995

[54] AUTOMATIC TERMINAL CRIMPING APPARATUS

[75] Inventors: Yukio Murakami; Yuji Watanabe, both of Yokkaichi, Japan

[73] Assignee: Sumitomo Wiring Systems, Ltd., Japan

[21] Appl. No.: 150,422

[22] Filed: Nov. 10, 1993

[30] Foreign Application Priority Data

Nov. 30, 1992 [JP] Japan ..... 4-345489

[51] Int. Cl.[6] ..... H01R 43/052

[52] U.S. Cl. ..... 29/33 M; 29/564.4; 29/721; 29/753

[58] Field of Search ..... 29/33 M, 564.6, 564.8, 29/712, 721, 753, 564.4, 748

[56] References Cited

U.S. PATENT DOCUMENTS

| | | | |
|---|---|---|---|
| 3,766,624 | 10/1973 | Grebe et al. | 29/564.8 |
| 4,030,174 | 6/1977 | Buttner et al. | 29/564.4 X |
| 4,077,118 | 3/1978 | McKeever | 29/748 |
| 4,347,651 | 9/1982 | Inoue et al. | 29/564.6 X |
| 4,641,428 | 2/1987 | Anderson | 29/564.6 X |
| 4,649,621 | 3/1987 | Dusel et al. | 29/564.4 |
| 4,672,871 | 6/1987 | Gudmestad et al. | 83/151 |
| 4,763,411 | 8/1988 | Takeshita | 29/748 X |
| 5,115,904 | 5/1992 | Folk et al. | 29/748 X |

FOREIGN PATENT DOCUMENTS

| | | |
|---|---|---|
| 2542743 | 4/1977 | Germany . |
| 189880 | 7/1990 | Japan . |

*Primary Examiner*—Z. R. Bilinsky

*Attorney, Agent, or Firm*—Jordan B. Bierman; Bierman and Muserlian

[57] ABSTRACT

There is disclosed an automatic terminal crimping apparatus (1) which comprises a cable cutting station (3), a mark positioning station (4), a mark location rotating station (5), a stripping station (6) and a terminal crimping station (7). The mark positioning station (4) includes a television camera (14) for image processing which senses a discrimination mark (8) of a high-voltage resistant cable (2), and circumferentially rotates the high-voltage resistant cable (2) and stops the rotation upon detection of the discrimination mark (8). At the mark location rotating station (5), the high-voltage resistant cable (2) positioned at the mark positioning station (4) is circumferentially rotated through a predetermined angle to orient the discrimination mark 8 in a predetermined direction. The automatic terminal crimping apparatus (1) is thus capable of performing a series of operations including cutting of the high-voltage resistant cable (2), positioning of the discrimination mark (8) with respect to a bent terminal (18), and crimping of the bent terminal (18).

10 Claims, 3 Drawing Sheets

AUTOMATIC TERMINAL CRIMPING APPARATUS

BACKGROUND OF THE INVENTION

1. Field of the Invention

The present invention relates to an automatic terminal crimping apparatus which is particularly suitable for crimping a bent terminal provided with a cable connection part and a terminal connection part which are integral with each other to form a bend, to connect the bent terminal to a cable.

2. Description of the Prior Art

A conventional automatic terminal crimping apparatus comprises a cable cutting station for cutting a serially supplied cable to a predetermined length, a stripping station for stripping a sheath from the cut cable at an end, and a terminal crimping station for connecting a terminal to the stripped cable end by crimping, these stations being provided along the transport path of the cable. At the terminal crimping station, the connection by crimping is performed on a straight terminal and a bent terminal. The straight terminal includes a cable connection part to be connected to the cable and a terminal connection part to be connected to an electrical equipment which are integrally formed in a straight line, and the bent terminal includes a cable connection part and a terminal connection part which are integral with each other to form a bend.

Some recent wound high-voltage resistant cables for use as ignition cables in an ignition circuit for an automotive engine have a discrimination mark such as a cylinder number printed longitudinally on its outer peripheral surface. On the other hand, because of relation between the arrangement of high-voltage resistant cables and connecting position thereof to electrical equipments, various types of bent terminals are used each having a cable connection part to be connected to a high-voltage resistant cable and a terminal connection part to be connected to an electrical equipment which are integral with each other to form a bend.

The bent terminal has been connected to the high-voltage resistant cable such that the discrimination mark of the high-voltage resistant cable is oriented toward a predetermined direction with respect to the bent terminal for purposes of improvements in assembling and commercial quality of the ignition cable in an automotive assembly line.

In the conventional automatic terminal crimping apparatus as above mentioned, it has been impossible in terminal connection to vary the predetermined direction of the discrimination mark of the high-voltage resistant cable in accordance with the type of the bent terminals. Hence, in the conventional connection, the high-voltage resistant cable has been cut to length and the cut cables have been stripped of a sheath at an end by machine, and then the cables have been aligned to a predetermined position of a terminal crimping apparatus while an operator visually confirming the high-voltage resistant cables one by one so that the discrimination mark of each cable is oriented toward the predetermined direction with respect to the bent terminal.

According to the conventional method, an operator has manually oriented the discrimination marks toward the predetermined direction with respect to the bent terminals, which is labor- and time-consuming and degrades the production efficiency.

SUMMARY OF THE INVENTION

The present invention is intended for an automatic terminal crimping apparatus for crimping a cable connection part of a bent terminal to connect the cable connection part of the bent terminal to an end of a cable having a discrimination mark printed longitudinally on its outer peripheral surface, the bent terminal including the cable connection part and a terminal connection part integral with each other to form a bend. According to the present invention, the apparatus comprises: a cable cutting station for cutting an elongated cable to a predetermined length to form the cable having the discrimination mark; transport means for transporting the cable cut at the cable cutting station along a predetermined transport path; a mark positioning station including imaging means in a first transport position on the transport path for imaging the discrimination mark, the mark positioning station circumferentially rotating the cable and stopping the rotation on detecting the discrimination mark by the imaging means to position the discrimination mark toward the imaging means; a mark location rotating station in a second transport position on the transport path for circumferentially rotating the mark-positioned cable through a predetermined angle to orient the discrimination mark in a predetermined direction; a stripping station in a third transport position on the transport path for stripping a sheath from the cable end; and a terminal crimping station in a fourth transport position on the transport path for crimping the cable connection part of the bent terminal to connect the cable connection part of the bent terminal to the stripped cable end.

According to the present invention, the cable is cut to length at the cable cutting station. The cut cable is circumferentially rotated at the mark positioning station. The rotation of the cable is stopped when the imaging means detects the discrimination mark which is printed on the outer peripheral surface of the cable. Thus, at the mark positioning station, the discrimination mark is positioned at the given location toward the imaging means.

At the mark location rotating station, the cable whose discrimination mark is positioned by the mark positioning station is circumferentially rotated through the predetermined angle so that the discrimination mark is oriented in the predetermined direction. Thus, the discrimination mark is oriented toward a predetermined direction with respect to the bent terminal of the terminal crimping station.

At the stripping station, the cable is stripped of the sheath at its ends whereby a core wire of the cable is exposed.

At the terminal crimping station, the cable connection part of the bent terminal is crimped and connected to the stripped cable whose discrimination mark is oriented in the predetermined direction with respect to the bent terminal.

As described above, the automatic terminal crimping apparatus according to the present invention, therefore, automatically performs the series of operations including cutting of the cable, positioning of the discrimination mark with respect to the bent terminal and crimping of the bent terminal, thereby to improve the production efficiency.

According to another aspect of the present invention, the automatic terminal crimping apparatus comprises: a cable cutting station for cutting an elongated cable to a predetermined length to form the cable having the discrimination mark; transport means for transporting the cable cut at the cable cutting station along a predetermined transport path; a mark positioning and rotating station including imaging means in a first transport position on the transport path for imaging the discrimination mark, the mark positioning and rotating station circumferentially rotating the cable and stopping the rotation on detecting the discrimination mark by the imaging means to position the discrimination mark toward the imaging means, the mark positioning and rotating station then circumferentially rotating the mark-positioned cable through a predetermined angle to orient the discrimination mark in a predetermined direction; a stripping station in a second transport position on the transport path for stripping a sheath from the cable end; and a terminal crimping station in a third transport position on the transport path for crimping the cable connection part of the bent terminal to connect the cable connection part of the bent terminal to the stripped cable end.

The mark positioning and rotating station of the second aspect of the present invention has the functions of the mark positioning station and mark location rotating station, thereby accomplishing size reduction of the whole apparatus.

It is an object of the present invention to provide an automatic terminal crimping apparatus which is capable of automatically performing a series of operations including cutting of a cable, alignment of the orientation of a discrimination mark with respect to a bent terminal, and connection of the bent terminal to the cable.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
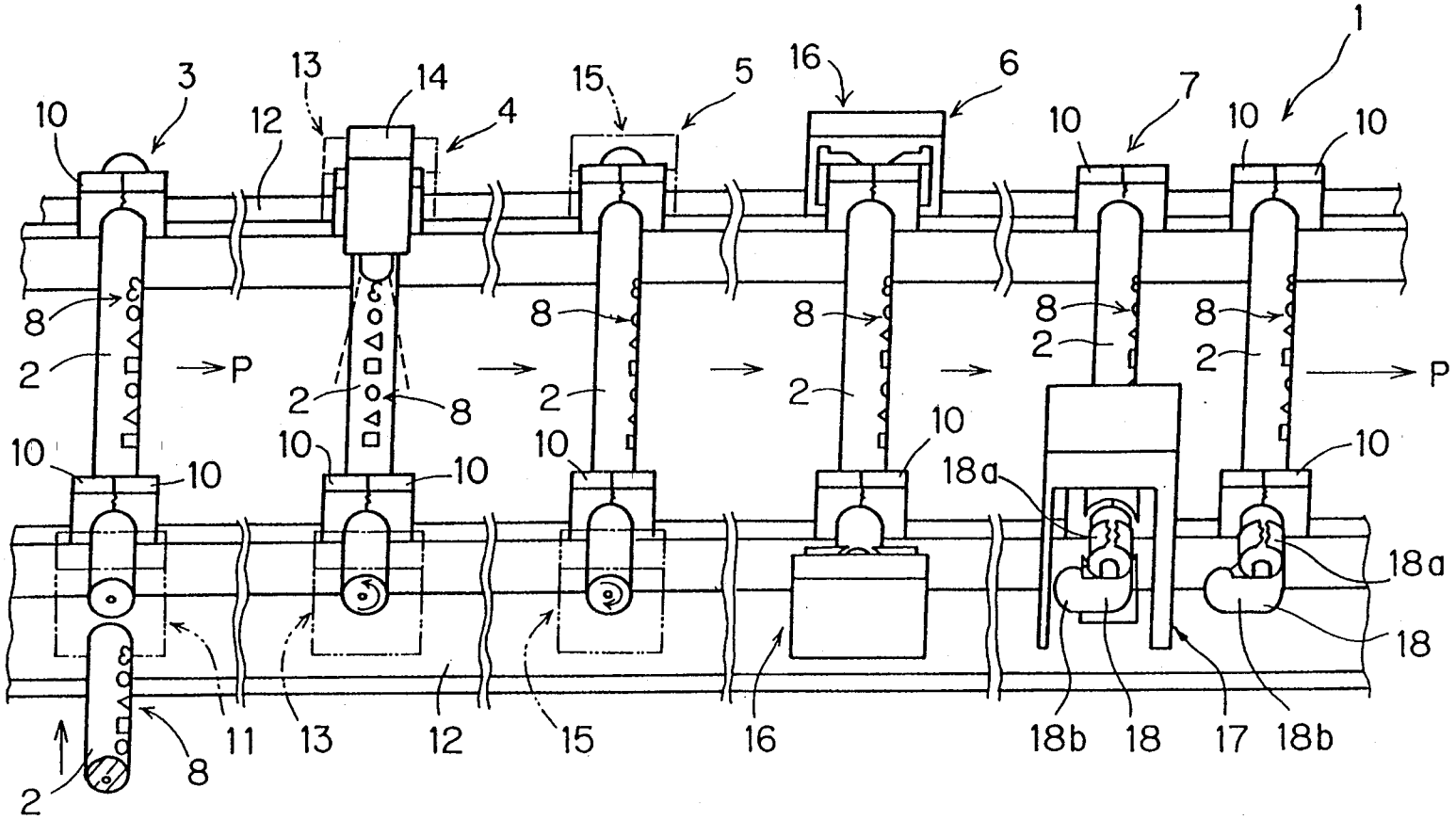
FIG. 1 schematically illustrates a major part of a first preferred embodiment of the present invention.

A first preferred embodiment of the present invention will be described hereinafter with reference to the appended drawings. In FIG. 1, the automatic terminal crimping apparatus 1 comprises a cable cutting station 3 for cutting an elongated high-voltage resistant cable 2 serially supplied from a reeling drum or the like to a predetermined length, a mark positioning station 4 in a first transport position, a mark location rotating station 5 in a second transport position, a stripping station 6 in a third transport position, and a terminal crimping station 7 in a fourth transport position, the stations 3 to 7 being provided sequentially along the transport path of the cut high-voltage resistant cables 2.

On the outer peripheral surface of the high-voltage resistant cable 2 is printed a discrimination mark 8 such as a cylinder number in the longitudinal direction.

The reference numeral 10 designates pairs of freely openable/closable transport clamps provided in multiplicity in spaced relation on endless transport conveyors including chains and belts along the length thereof. The transport conveyers are disposed on opposite sides along the transport path, and freely revolve intermittently in a predetermined direction P. The transport clamps 10, the transport conveyors and other elements form a transport means.

On the high-voltage resistant cable 2 supply side of the cable cutting station 3, there is provided a cutter mechanism 11 for cutting the high-voltage resistant cable 2. Upon receiving the high-voltage resistant cable 2 of a predetermined length, the cutter mechanism 11 is activated to cut the high-voltage resistant cable 2.

At the mark positioning station 4 are provided cable rotating mechanisms 13 serving as a first rotating mechanism and mounted on racks 12 seated respectively on the outside of the transport conveyers, and a television camera 14 serving as an imaging means for image processing and disposed above the high-voltage resistant cable 2. At the mark positioning station 4, image data of the high-voltage resistant cable 2 given from the television camera 14 is binarized, and the presence of the discrimination mark 8 on the outer peripheral surface of the high-voltage resistant cable 2 is judged from the number of pixels.

The cable rotating mechanisms 13 include chuck mechanisms for chucking opposite ends of the high-voltage resistant cable 2 when the high-voltage resistant cable 2 is transported to the mark positioning station 4. When the transport clamps 10 open and release the clamping, the chuck mechanisms are rotated in a predetermined direction by a rotary encoder, so that the high-voltage resistant cable 2 is rotated circumferentially. If the discrimination mark 8 is sensed by the television camera 14, the rotary encoder stops to stop the rotation of the high-voltage resistant cable 2. The discrimination mark 8 is then oriented upwardly toward the television camera 14.

At the mark location rotating station 5 are provided cable rotating mechanisms 15 serving as a second rotating mechanism and mounted on the respective racks 12. The cable rotating mechanisms 15 include chuck mechanisms for chucking the opposite ends of the high-voltage resistant cable 2 when the high-voltage resistant cable 2 is transported to the mark location rotating station 5. When the transport clamps 10 open and release the clamping, the chuck mechanisms are rotated through a predetermined angle (e.g., 90 degrees) in a predetermined direction by a rotary encoder, so that the high-voltage resistant cable 2 is circumferentially rotated through the predetermined angle (e.g., 90 degrees). The discrimination mark 8 is then oriented in a predetermined direction.

At the stripping station 6 are provided stripping mechanisms 16 mounted on the respective racks 12. As the high-voltage resistant cable 2 is transported to the stripping station 6, the stripping mechanisms 16 strip the sheath from the high-voltage resistant cable 2 at its opposite ends to expose a core wire of the high-voltage resistant cable 2.

At the terminal crimping station 7, there is provided a terminal crimping machine 17 disposed on one of the racks 12. The terminal crimping machine 17 comprises a terminal supply mechanism for serially supplying straight terminals and bent terminals which are previously set and a terminal crimping mechanism for connecting each terminal to the stripped end of the high-voltage resistant cable 2 by crimping. Bent terminals 18 having the discrimination mark 8 are set in the first preferred embodiment.

Operation of the automatic terminal crimping apparatus 1 will now be described.

The elongated high-voltage resistant cable 2 serially supplied from the reeling drum or the like is cut to length by the cutter mechanism 11 at the cable cutting station 3. The cut high-voltage resistant cable 2 is transported, with its both ends clamped by the transport clamps 10, to the mark positioning station 4 in the first transport position by the revolution of the transport conveyers in the predetermined direction P.

As the cut high-voltage resistant cable 2 reaches the mark positioning station 4, the chuck mechanisms of the cable rotating mechanisms 13 chuck the opposite ends of the high-voltage resistant cable 2. When the transport clamps 10 release the clamping, the chuck mechanisms are rotated in the predetermined direction by the rotary encoder. The television camera 14 monitors the upper surface of the high-voltage resistant cable 2. When the discrimination mark 8 printed on the outer peripheral surface of the high-voltage resistant cable 2 arrives at the center position of the upper surface thereof, the television camera 14 senses the discrimination mark 8, and the rotary encoder is stopped. The result is the positioned discrimination mark 8 oriented upwardly toward the television camera 14.

Then, the transport clamps 10 re-clamp the high-voltage resistant cable 2 while the chuck mechanisms release the chucking, and the high-voltage resistant cable 2 is transported to the mark location rotating station 5 in the second transport position by the revolution of the transport conveyers in the predetermined direction P.

As the high-voltage resistant cable 2 reaches the mark location rotating station 5, the chuck mechanisms of the cable rotating mechanisms 15 chuck the opposite ends of the high-voltage resistant cable 2. When the transport clamps 10 release the clamping, the chuck mechanisms are rotated through the predetermined angle (e.g., 90 degrees) in the predetermined direction by the rotary encoder. Thus, the discrimination mark 8 is positioned in predetermined angular relation (e.g., 90 degrees) to the upper surface of the high-voltage resistant cable 2, and the discrimination mark 8 is oriented in the predetermined direction. This allows the cable to be fed to the bent terminal 18 of the terminal crimping station 7, with the discrimination mark 8 oriented toward the predetermined direction with respect to the bent terminal 18.

Then, the transport clamps 10 re-clamp the high-voltage resistant cable 2 while the chuck mechanisms release the chucking, and the high-voltage resistant cable 2 is transported to the stripping station 6 in the third transport position by the revolution of the transport conveyers in the predetermined direction P.

As the high-voltage resistant cable 2 reaches the stripping station 6, the stripping mechanisms 16 are brought into operation to strip the sheath of a predetermined length from the high-voltage resistant cable 2 at its opposite ends to expose the core wire of the high-voltage resistant cable 2.

Figure 2:
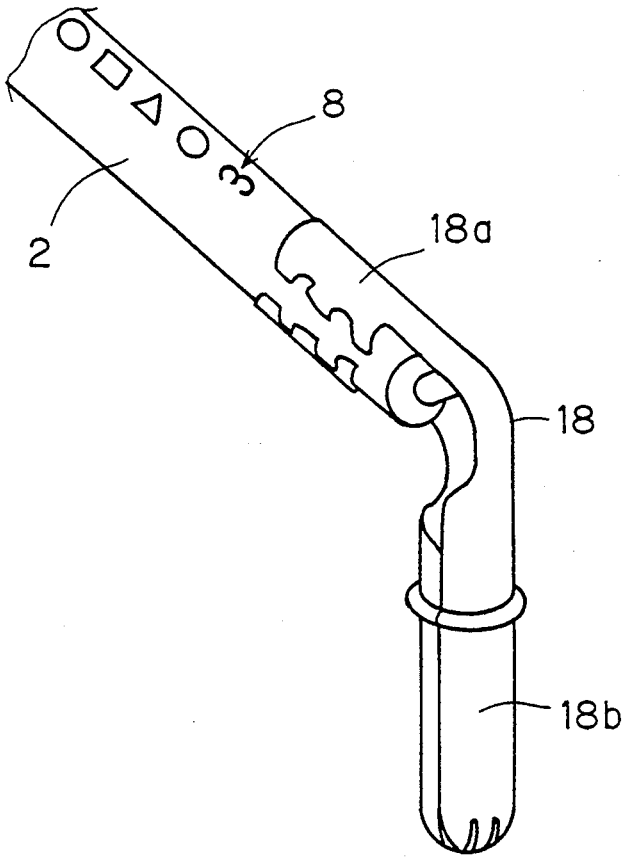
FIG. 2 is a perspective view of a crimped bent terminal.

The high-voltage resistant cable 2 is in turn transported to the terminal crimping station 7 in the fourth transport position by the revolution of the transport conveyers in the predetermined direction P. As the high-voltage resistant cable 2 reaches the terminal crimping station 7, the terminal crimping machine 17 is activated to connect a cable connection part 18*a* of the bent terminal 18 to one end of the high-voltage resistant cable 2. Since the discrimination mark 8 of the high-voltage resistant cable 2 is oriented in the predetermined direction at the mark location rotating station 5, the connection is made such that the discrimination mark 8 of the high-voltage resistant cable 2 is always oriented toward the predetermined direction with respect to a terminal connection part 18*b* of the bent terminal 18 as shown in FIG. 2.

The connected cable 12 and bent terminal 18 is transported to a predetermined location by the revolution of the transport conveyers in the predetermined direction P, and then discharged to a predetermined discharge portion.

As heretofore described, the automatic terminal crimping apparatus 1 according to the present invention is capable of automatically performing the series of operations including cutting of the high-voltage resistant cable 2 to the predetermined length, positioning of the discrimination mark 8 with respect to the bent terminal 18 and crimping of the bent terminal 18, thereby improving the production efficiency.

The rotation angle at the mark location rotating station 5 should be suitably adjusted depending on the orientation of the discrimination mark 8 with respect to the bent terminal 18. For crimping of a straight terminal, the rotation angle should be zero, or alternatively, the high-voltage resistant cable 2 should be adapted to pass through the mark positioning station 4 and mark location rotating station 5 without being processed.

Figure 3:
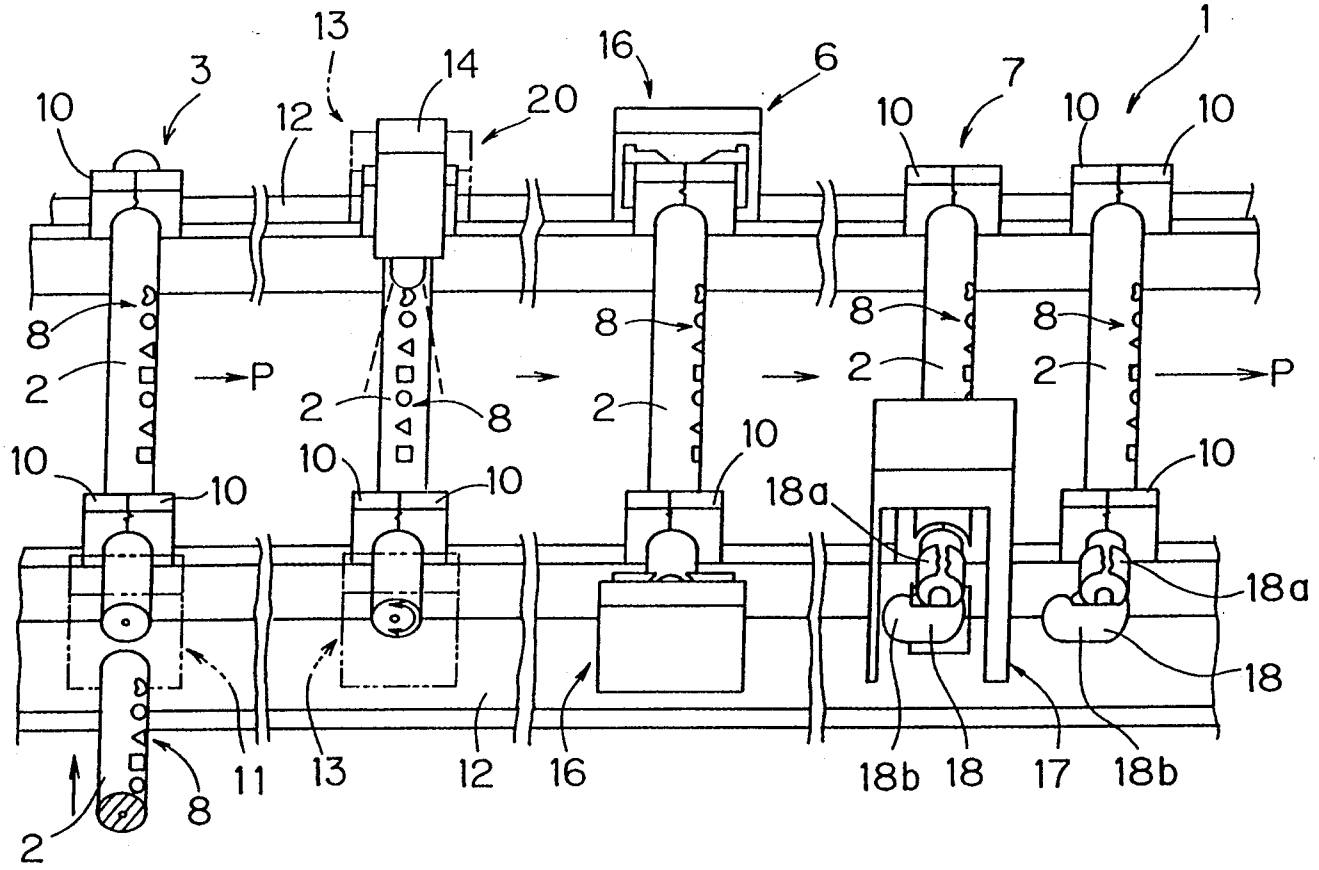
FIG. 3 schematically illustrates a major part of a second preferred embodiment of the present invention.

FIG. 3 illustrates a second preferred embodiment of the present invention. The automatic terminal crimping apparatus 1 of the second preferred embodiment is similar in construction to that of the first preferred embodiment except that a mark positioning and rotating station 20 is substituted for the mark positioning station 4 and mark location rotating station 5 of the first preferred embodiment. The mark positioning and rotating station 20 positions and orients the mark discrimination mark 8 upwardly toward the television camera 14, and then rotates the chuck mechanisms through a predetermined angle in a predetermined direction by means of the rotary encoder of the cable rotating mechanisms 13 to orient the discrimination mark 8 in a predetermined direction. That is, the automatic terminal crimping apparatus 1 of the second preferred embodiment comprises the cable cutting station 3, the mark positioning and rotating station 20 in a first transport position, the stripping station 6 in a second transport position, and the terminal crimping station 7 in a third transport position, the stations 3, 20, 6, 7 being provided sequentially along the transport path of the cut high-voltage resistant cable 2.

The provision of the mark positioning and rotating station 20 having two functions combined affords size reduction of the whole apparatus 1.

While the invention has been shown and described in detail, the foregoing description is in all aspects illustrative and not restrictive. It is therefore understood that numerous modifications and variations can be devised without departing from the scope of the invention.

What is claimed is:

1. An automatic terminal crimping apparatus for crimping a cable connection part of a bent terminal to connect said cable connection part of said bent terminal to an end of a cable having a discrimination mark printed longitudinally on its outer peripheral surface, said bent terminal including said cable connection part and a terminal connection part integral with each other to form a bend, said apparatus comprising:

a cable cutting station for cutting an elongated cable to a predetermined length to form said cable having said discrimination mark;

transporter for transporting said cable cut at said cable cutting station along a predetermined transport path;

a mark positioning station including imaging element in a first transport position on said transport path for imaging said discrimination mark, said mark positioning station circumferentially rotating said cable and stopping the rotation on detecting said discrimination mark by said imaging element to position said discrimination mark toward said imaging element;

a mark location rotating station in a second transport position on said transport path for circumferentially rotating said mark-positioned cable through a predetermined angle to orient said discrimination mark in a predetermined direction;

a stripping station in a third transport position on said transport path for stripping a sheath from said cable end; and a terminal crimping station in a fourth transport position on said transport path for crimping said cable connection part of said bent terminal to connect said cable connection part of said bent terminal to said stripped cable end.

2. The automatic terminal crimping apparatus of claim 1, wherein said cable cutting station, said mark positioning station, said mark location rotating station, said stripping station, and said terminal crimping station are provided sequentially along said transport path.

3. The automatic terminal crimping apparatus of claim 1, wherein said transporter includes a transport clamp for transporting said cable along said transport path while releasably clamping opposite ends of said cable.

4. The automatic terminal crimping apparatus of claim 1, wherein said imaging element includes a television camera located above a stop position of said cable at said mark positioning station.

5. The automatic terminal crimping apparatus of claim 1, wherein said cable cutting station includes a cutting mechanism located at its one end on the supply side of said elongated cable for cutting said elongated cable;

said mark positioning station includes a first rotating mechanism for clamping the opposite ends of said cable in said first transport position to rotate said cable;

said mark location rotating station includes a second rotating mechanism for clamping the opposite ends of said cable in said second transport position to rotate said cable;

said stripping station includes a stripping mechanism for stripping the sheath from said cable at the opposite ends in said third transport position; and said terminal crimping station includes a terminal crimping machine for crimping said bent terminal to connect said bent terminal to the opposite ends of said cable in said fourth transport position.

6. An automatic terminal crimping apparatus for crimping a cable connection part of a bent terminal to connect said cable connection part of said bent terminal to an end of a cable having a discrimination mark printed longitudinally on its outer peripheral surface, said bent terminal including said cable connection part and a terminal connection part integral with each other to form a bend, said apparatus comprising:

a cable cutting station for cutting an elongated cable to a predetermined length to form said cable having said discrimination mark;

transporter for transporting said cable cut at said cable cutting station along a predetermined transport path;

a mark positioning and rotating station including imaging element in a first transport position on said transport path for imaging said discrimination mark, said mark positioning and rotating station circumferentially rotating said cable and stopping the rotation on detecting said discrimination mark by said imaging element to position said discrimination mark toward said imaging element, said mark positioning and rotating station then circumferentially rotating said mark-positioned cable through a predetermined angle to orient said discrimination mark in a predetermined direction;

a stripping station in a second transport position on said transport path for stripping a sheath from said cable end; and a terminal crimping station in a third transport position on said transport path for crimping said cable connection part of said bent terminal to connect said cable connection part of said bent terminal to said stripped cable end.

7. The automatic terminal crimping apparatus of claim 6, wherein said cable cutting station, said mark positioning and rotating station, said stripping station, and said terminal crimping station are provided sequentially along said transport path.

8. The automatic terminal crimping apparatus of claim 6, wherein said transporter includes a transport clamp for transporting said cable along said transport path while releasably clamping opposite ends of said cable.

9. The automatic terminal crimping apparatus of claim 6, wherein said imaging element includes a television camera located above a stop position of said cable at said mark positioning and rotating station.

10. The automatic terminal crimping apparatus of claim 6, wherein said cable cutting station includes a cutting mechanism located at its one end on the supply side of said elongated cable for cutting said elongated cable;

said mark positioning and rotating station includes a rotating mechanism for clamping the opposite ends of said cable in said first transport position to rotate said cable;

said stripping station includes a stripping mechanism for stripping the sheath from said cable at the opposite ends in said second transport position; and said terminal crimping station includes a terminal crimping machine for crimping said bent terminal to connect said bent terminal to the opposite ends of said cable in said third transport position.

* * * * *